US007177553B2

(12) United States Patent
Ono

(10) Patent No.: US 7,177,553 B2
(45) Date of Patent: Feb. 13, 2007

(54) PART DETERMINATION DEVICE, PART ATTACHMENT AND DETACHMENT APPARATUS, IMAGE FORMING APPARATUS, AND PART DETERMINATION METHOD

(75) Inventor: Tomohiro Ono, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 221 days.

(21) Appl. No.: 11/032,181

(22) Filed: Jan. 11, 2005

(65) Prior Publication Data

US 2005/0244169 A1 Nov. 3, 2005

(30) Foreign Application Priority Data

Apr. 30, 2004 (JP) ..... 2004-135295

(51) Int. Cl.
*G03G 15/00* (2006.01)

(52) U.S. Cl. ..... 399/12; 399/24

(58) Field of Classification Search ..... 399/9, 399/12, 24, 25, 26, 27, 30, 109, 111; 347/19
See application file for complete search history.

(56) References Cited

U.S. PATENT DOCUMENTS 6,978,255 B1 * 12/2005 Pauschinger et al. ..... 705/61
6,996,347 B2 * 2/2006 Ito et al. ..... 399/12
7,043,166 B2 * 5/2006 Parry et al. ..... 399/12
2002/0028080 A1 * 3/2002 Naito et al. ..... 399/12
2002/0051645 A1 * 5/2002 Abe ..... 399/12

FOREIGN PATENT DOCUMENTS

JP 64-57272 3/1989
JP 1-200272 8/1989
JP 2002-331686 11/2002

* cited by examiner

*Primary Examiner*—Hoan Tran
(74) *Attorney, Agent, or Firm*—Morgan, Lewis & Bockius, LLP

(57) ABSTRACT

A part determination device used in an apparatus having a replacement part, including an identification information acquisition section that acquires individual identification information for identifying a replacement part from the replacement part, an information acquisition section that acquires information indicating whether or not the replacement part is an approved part from the replacement part, a determination section that determines whether or not a replacement part is an approved part based on information acquired by the information acquisition section, and a first registration section that, when it is determined by the determination section that a replacement part is not an approved part, registers individual identification information acquired by the identification information acquisition section in a predetermined first storage region.

20 Claims, 4 Drawing Sheets

| MANAGEMENT NO. | INDIVIDUAL IDENTIFICATION NO. | REPLACEMENT PART TYPE | TIME AND DATE OF INSTALLATION | TRANSMISSION STATUS |
|---|---|---|---|---|
| 0 | 12-34-56-FF | Black-DRUM | 2003/12/24 12:25 | SENT |
| 1 | FC-DE-11-22 | Cyan-TONER | 2003/12/27 14:38 | SENT |
| 2 | 35-22-AB-FC | Cyan-TONER | 2004/02/14 16:38 | NOT SENT |
| 3 | BB-94-56-00-01 | Black-TONER | 2004/02/22 16:38 | NOT SENT |
| | | | | |
| | | | | |

Fig. 3

| MANAGEMENT NO. | INDIVIDUAL IDENTIFICATION NO. | REPLACEMENT PART TYPE |
|---|---|---|
| 0 | 92-35-26-CF | Black-DRUM |
| 1 | FD-DD-38-25 | Cyan-TONER |
| 2 | 44-18-CC-AA | Cyan-TONER |
| 3 | CD-14-56-99-14 | Black-TONER |
| | | |
| | | |

Fig. 4

PART DETERMINATION DEVICE, PART ATTACHMENT AND DETACHMENT APPARATUS, IMAGE FORMING APPARATUS, AND PART DETERMINATION METHOD

BACKGROUND OF THE INVENTION

1. Field of the Invention

The present invention relates to a part determination device used in an apparatus having a replacement part in a detachable manner, a part attachment and detachment apparatus provided with this part determination device, and an image forming apparatus provided with the part determination device.

2. Description of the Related Art

In the art of image forming apparatuses such as copiers or printers, attaching replacement parts, such as a drum cartridge or a toner cartridge, to the apparatus main body in a detachable manner is well known. Normally, the manufacturer of the apparatus main body will assume that the replacement parts to be fitted will be parts approved by the manufacturer, either original or recommended parts, and the apparatus main body is then designed and manufactured so as to achieve predetermined image quality and safety performance based on this assumption.

When replacement parts whose use is not confirmed (such as imitation parts, counterfeit parts, pirated versions, etc.) are fitted to the apparatus main body, which is designed and manufactured in the above way, various disadvantages may arise, because operation in this case is outside the range assumed by the manufacturer. For example, problems regarding image quality, erroneous operation, damage to the apparatus main body, or damage to printing paper (tearing, crumpling, etc.), become a concern.

In order to avoid the above-described disadvantages, a technique is adopted to automatically determine whether or not replacement parts being fitted are genuine parts, etc., and, in the event that they are not genuine parts, prohibiting an image forming operation or displaying a warning (refer, for example, to Japanese patent Laid-open Publication No. 2002-331686). As a method for determining whether or not replacement parts are genuine parts, there is the following method disclosed in Japanese patent Laid-open Publication No. 2002-331686. Specifically, information indicating that replacement parts are genuine parts is written to a non-contact IC tag the replacement parts are provided with. The apparatus main body reads information from the non-contact IC tag, and determines whether or not the replacement parts are genuine parts based on the read information.

In Japanese patent Laid-open Publication No. Hei 1-200272, there is disclosed a technique for identifying the type of a cartridge containing a photosensitive drum, and when loading a different type of cartridge, that fact is displayed, and copy operation is prohibited. Also, in Japanese patent Laid-open Publication No. Sho 64-57272, there is disclosed a technique for, in the event that it is determined that a unit whose service life has expired is fitted, that fact is displayed, and the main body is prevented from starting up. In this document there is also disclosed a technique for storing multiple identify numbers for units that have been attached up to now in a non volatile RAM, and carrying out service life management for multiple units.

A fitting history of unapproved replacement parts, whose use has not been confirmed by the manufacturer, is beneficial for a number of reasons. For example, the fitting history is useful in investigating cases where trouble arise in an image forming apparatus. It is also beneficial as information when ascertaining distribution conditions for unapproved replacement parts in the market place. Further, by using the fitting history in determining whether or not the replacement parts are approved parts, it is possible to simplify or speed up determination processing.

This type of situation is not limited to image forming apparatuses, and the same is also true for other apparatuses having a replacement part that can be attached and detached.

SUMMARY OF THE INVENTION

The present invention is a part determination device used in an apparatus in which a replacement part can be fitted, comprising an identification information acquisition section that acquires individual identification information for identifying a replacement part from the replacement part, an information acquisition section that acquires information indicating whether or not the replacement part is an approved part from the replacement part, a determination section that determines whether or not a replacement part is an approved part based on information acquired by the information acquisition section, and a first registration section that, in the event that it is determined by the determination section that a replacement part is not an approved part, registers individual identification information acquired by the identification information acquisition section in a specified first storage region.

The present invention is also a part determination method used in an apparatus in which a replacement part can be fitted, comprising an identification information acquisition step for acquiring individual identification information for identifying a replacement part from the replacement part, an information acquisition step for acquiring information indicating whether or not the replacement part is an approved part from the replacement part, a determination step for determining whether or not a replacement part is an approved part based on information acquired at the information acquisition step, and a first registration step for, in the event that it is determined in the determination step that a replacement part is not an approved part, registering individual identification information acquired in the identification information acquisition step in a specified first storage region.

BRIEF DESCRIPTION OF THE DRAWINGS

A preferred embodiment of the present invention will be described in detail based on the following figures, wherein:

FIG. 3 is a drawing showing one example of a first table;

FIG. 4 is a drawing showing one example of a second table; and

DETAILED DESCRIPTION OF THE DRAWINGS

An embodiment of the present invention will be described in the following based on the drawings.

Figure 1:
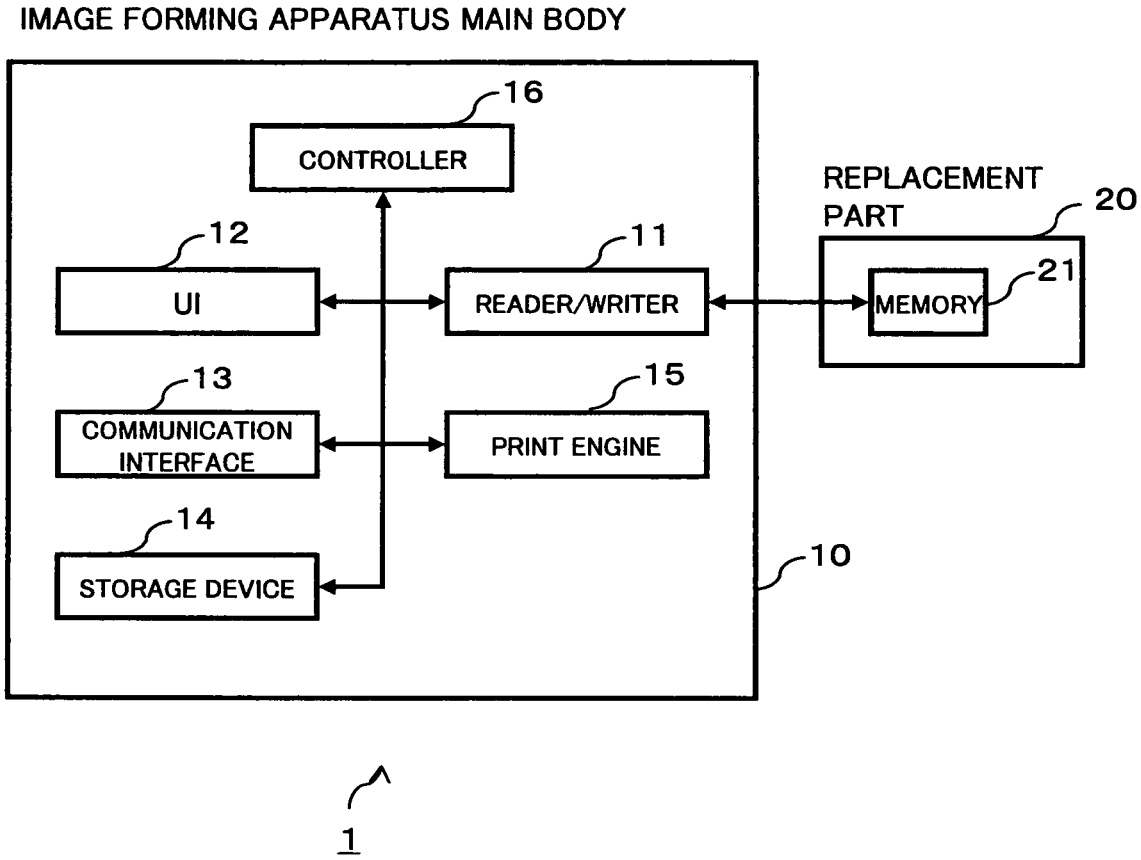
FIG. 1 is a block diagram showing the structure of an image forming apparatus containing a part determination device of an embodiment.

FIG. 1 is a block diagram showing the structure of an image forming apparatus 1 containing a part determination device according to the present embodiment. This image forming apparatus 1 is an apparatus for printing an image to a recording medium such as paper, such as a copier, printer, facsimile machine, etc. With this embodiment, an electrophotographic method is described as a printing method, but it is also possible to use another method such as an ink jet method.

In FIG. 1, the image forming apparatus 1 is provided with an image forming apparatus main body 10 (hereafter referred to as apparatus main body), and a replacement part 20 fitted in a detachable manner to the apparatus main body 10. The apparatus main body 10 is substantially a fixed section in the image forming apparatus 1. The replacement part 20 is generally a part that is preferably replaced after a certain amount of use. The replacement part can be, for example, a photosensitive drum cartridge, a development unit, a toner cartridge, a transfer unit, or a fixing unit, etc. Although there is only one replacement part 20 in FIG. 1, it is possible to have a plurality of replacement parts.

As used herein, replacement parts whose use is approved by the manufacturer, such as genuine parts and recommended parts, are referred to collectively as "approved parts". Also, replacement parts whose use is not authorized by the manufacturer, such as imitation parts, counterfeit parts, pirated versions, etc. are collectively referred to as "unapproved parts".

A memory 21, which is a non-volatile storage medium, is attached to the replacement parts 20. Individual identification information of the replacement part 20 and information indicating whether or not the replacement part 20 is an approved part are held in this memory 21. In one embodiment, this memory 21 is also used as a memory for storing control information such as a compensation value for manufacturing variation of the replacement parts, usage history, etc. With this embodiment, the memory 21 is a semiconductor memory contained in an RFID (Radio Frequency Identification) tag, and reading/writing of data is carried out in a wireless manner. However, it is also possible for the memory 21 to be another type of storage medium, such as a magnetic memory or an optical memory. It is also possible for the memory 21 to be accessed in a wired manner, or to be non-rewritable.

The individual identification information for the replacement part 20 is information for identifying a particular replacement part 20 from another replacement part 20. Preferably, this individual identification information is stored in such a manner that it cannot easily be copied, from the viewpoint of prevention of dead copy. With this embodiment, a unique individual identification number in the RFID tag (serial number), which burnt into a ROM region of the RFID tag at the time of manufacture, is used as the individual identification information. Specific content of the information indicating whether or not the replacement part 20 is an approved part will be described in detail later.

The apparatus main body 10 is provided with a reader/writer 11, a user interface (UI) 12, a communication interface 13, a storage device 14, a print engine 15, and a controller 16.

The reader/writer 11 is a communication module for reading and writing information to and from the memory 21. Here, the reader/writer 11 is arranged close to the RFID tag containing the memory 21, and is a coupler for carrying out non-contact communication with the memory 21. When plural replacement parts 20 are attached, a reader/writer is provided for each replacement part 20. In this case, it is also possible for a single reader/writer 11 to handle two or more replacement parts 20.

The UI 12 is an interface for carrying out display of various information and receipt of input operations from a user, and is, for example, a display, operation buttons, or a touch type control panel.

The communication interface 13is an interface for interchanging information with an external information processing device in a wired or wireless manner, and is a LAN (Local Area Network) interface, a USB (Universal Serial Bus) interface, serial interface, or parallel interface, etc.

The storage device 14 is a non-volatile storage medium for storing various information, such as a hard disk unit or an NVRAM (Non Volatile RAM).

The print engine 15 is a unit for printing images to a recording medium in accordance with an electrophotographic process, and is provided with a charger, a laser scanning optical system (ROS: Raster Output Scanner), a developer, a transfer unit, a fuser, respective motors, and a power supply circuit for biasing these sections and supplying electrical power to them.

The controller 16 performs overall control of the image forming apparatus 1, and also functions as the part determination device of this embodiment. Here, the controller 16 is a circuit board on which a CPU, ROM, and RAM, etc. are mounted. The function for overall control of the image forming apparatus 1 and the function as the part determination device are realized by executing programs stored in a storage medium such as ROM etc. on the CPU. However, the way in which each of these functions is realized is not particularly limited, and it is also possible, for example, to realize a function by a dedicated hardware circuit.

Figure 2:
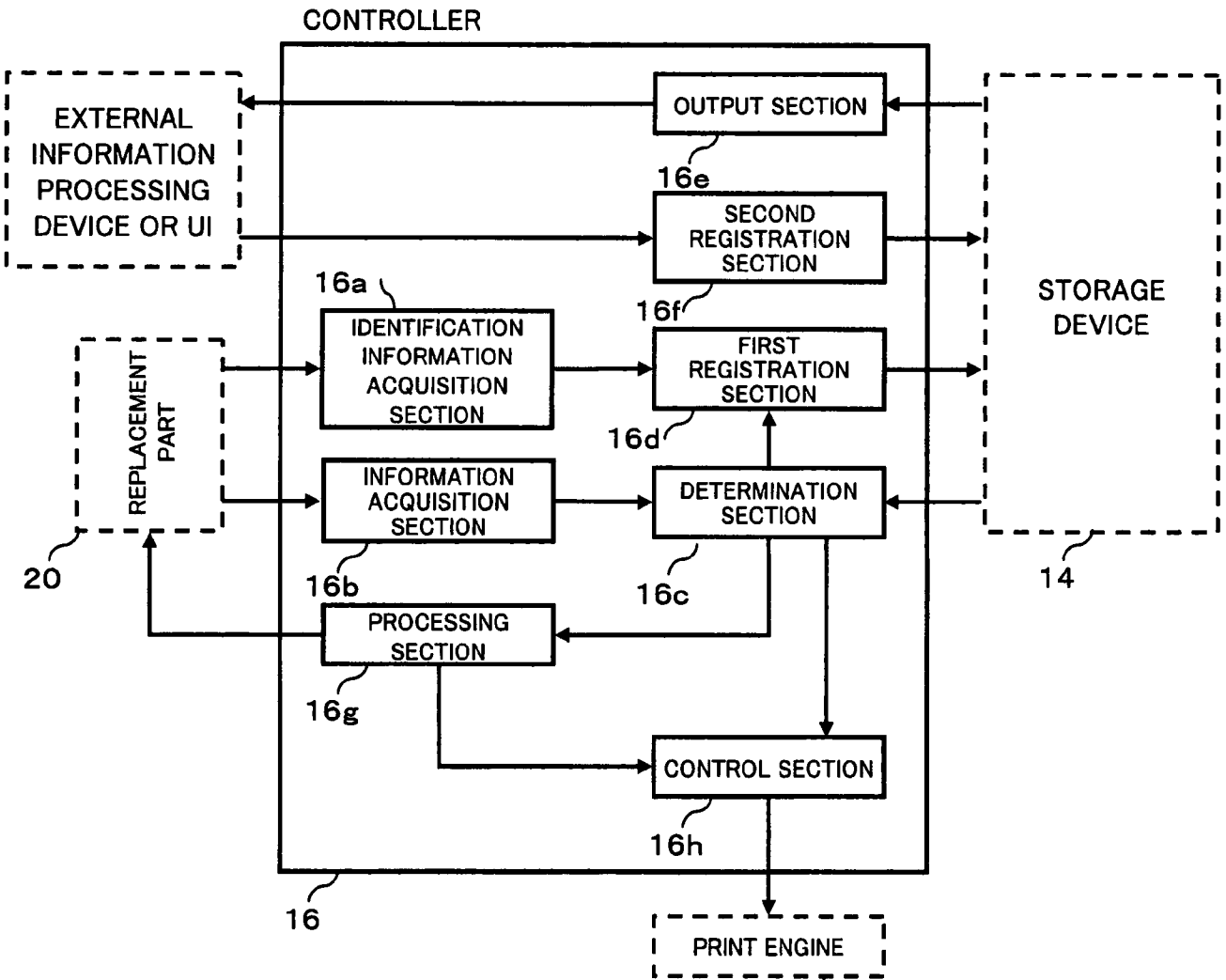
FIG. 2 is a block diagram showing the functional structure of a controller.

FIG. 2 is a block diagram showing the functional structure of a controller 16. As shown in FIG. 2, the controller 16 includes an identification information acquisition section 16*a*, an information acquisition section 16*b*, a determination section 16*c*, a first registration section 16*d*, an output section 16*e*, a second registration section 16*f*, a processing section 16*g*, and a control section 16*h*.

The identification information acquisition section 16*a* acquires individual identification information for the replacement part from the replacement part 20. Specifically, a unique individual identification number is read out from the memory 21 of the replacement part 20, via the reader/writer 11.

The information acquisition section 16*b* acquires information indicating whether or not the replacement part is an approved part from the replacement part 20. Specifically, predetermined information is read out from the memory 21 of the replacement part 20, via the reader/writer 11.

The determination section 16*c* determines whether or not the replacement part 20 is an approved part based on information acquired by the information acquisition section 16*b*. The method of this determination is not limited, and various methods can be adopted. The specific contents of the determination method will be described later using examples.

The first registration section 16*d* registers an individual identification number acquired by the identification information acquisition section 16*a* in a predetermined storage region in the event that it is determined by the determination section 16*c* that the replacement part 20 is not an approved part. With this embodiment, the first registration section 16*d* stores the individual identification number in the storage device 14. However, it is also possible for the first registration section 16*d* to also register the number in a non-volatile memory contained in the controller 16, or in an external storage device via the communication interface 13. Here, as the external storage device, for example, an externally connected hard disk unit or a data base server on the Internet can be considered. From the view point of registration of a useful fitting history, it is preferable for the predetermined storage region to be capable of holding multiple individual identification numbers. Also, for the same reason, regardless of the determination result, it is preferable for the first registration section 16*d* to register the individual identification number and the determination result in a correlated manner. Further, for the same reason, it is preferable for the first registration section 16*d* to store information that improves the usefulness of the history information correlated to the individual identification number. Here, as the information for improving usefulness, for example, there is time of installation and removal, a counter value of the image forming apparatus at the time of fitting and removal (cumulative print number, cumulative rotation number), type of replacement part when plural types of replacement parts are fitted, date of manufacture, and manufacturing number.

The output section 16*e* reads out an individual identification number registered by the first registration section 16*d* from the storage device 14 and outputs to the outside. In one aspect, the output section 16*e* transmits the individual identification number to an external information processing device via the communication interface 13 and a communication channel. Here, as the communication channel, for example, a wired LAN, a wireless LAN, a telephone line, a mobile telephone line, a serial cable, or a parallel cable can be considered. Also, as the external information processing device, for example, a management unit held by an engineer (hereafter referred to as a service engineer) trained to repair or maintain the image forming apparatus 1, a personal computer (hereafter referred to as a PC) used by a device manager, a PC used by a general user, a server on a LAN or the Internet, or a management center of the manufacturer, etc. can be considered. Transmitting of the individual identification number can be carried out in response to a request from an external information processing device, or carried out automatically at a predetermined time (for example, at a fixed period). In another aspect, the output section 16*e* causes the individual identification number to be displayed on a display screen of the UI 12. In the event that the individual identification number is correlated to other information, the output section 16*e* can also output the other information externally.

The second registration section 16*f* acquires an individual identification number of a replacement part 20 that has been determined to be not an approved part from outside, and registers this number in a predetermined storage region. In one aspect, the second registration section 16*f* receives an individual identification number for a replacement part that has been determined to be not an approved part by another image forming apparatus or the like from an external information processing device via the communication interface 13 and a communication channel, and stores the number in the storage device 14. Here, the communication channel and external information processing device can be considered to be the same as described above. Receipt of the individual identification number from the external information processing device can be a pull type or push type. In another aspect, the second registration section 16*f* receives input of an individual identification number from a service engineer or the like via the UI 12, and stores the number in the storage device 14.

The processing section 16*g* executes predetermined processing corresponding to a case where a part other than an approved part has been fitted, in the event that it is determined by the determination section 16*c* that the replacement part 20 is not an approved part. This predetermined processing is typified by processing for avoiding drawbacks and disadvantages such as apparatus failure accompanying use of unapproved parts, but will be described in detail later.

The control section 16*h* performs overall control of the image forming apparatus 1. For example, the control section 16*h* receives a printing instruction from a user via the UI 12, or receives a printing instruction from a PC via the communication interface 13, and controls the print engine 15 in response to these printing instructions. In this case, the control section 16*h* reads out a compensation value or usage history information from the memory 21 via the reader/writer 11, and controls the print engine 15 based on the read out information.

Next, data held in the storage device 14 will be described. In the example used to illustrate the present embodiment, information from the first registration section 16*d* is registered in a first table, while information from the second registration section 16*f* is registered in second table.

FIG. 3 is a drawing showing one example of a first table. In this first table, "individual identification number" is held correlated to "replacement part type", "fitting time", and "transmitted or not transmitted". New records are added to this first table by the first registration section 16*d*. In the "transmitted or not transmitted" field, "sent" indicates that the record has been transmitted to the external information processing device, and "not sent" indicates that the record has not been sent to the external information processing device. By referencing this "transmitted or not transmitted" field, it is possible to selectively transmit previously untransmitted records to the external information processing device.

FIG. 4 is a drawing showing one example of a second table. In this second table, "individual identification number" is held correlated to "replacement part type". New records are added to this second table by the second registration section 16*f*.

Data of the above-described first and second tables can preferably be edited, such as added, corrected, or deleted, by an external information processing unit or the UI 12. With this embodiment, the first table and the second table are divided, but it is also possible for information from the first registration section 16*d* and information from the second registration section 16*f* to be stored in the same table.

Operation of the image forming apparatus 1 having the above-described structure will be described in the following. Processing for the case where a part other than an approved part is fitted will be described in detail, after description of overall operation of the image forming apparatus 1. General image formation operation of the image forming apparatus 1 is widely known and so description is omitted.

[Overall Operation of Image Forming Apparatus]

Figure 5:
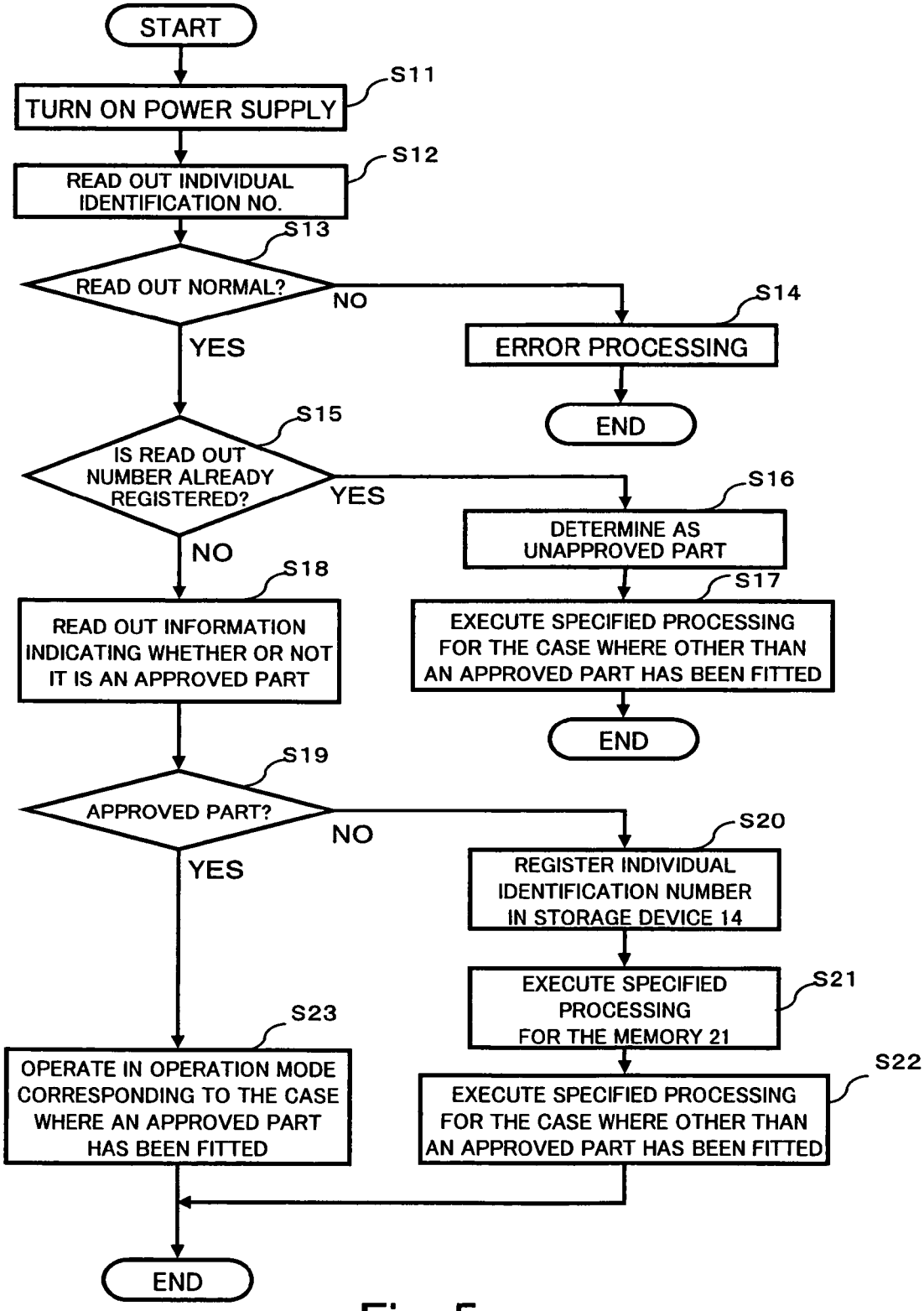
FIG. 5 is a flowchart showing an overall operation sequence of an image forming apparatus.

FIG. 5 is a flowchart showing an overall operation sequence of the image forming apparatus 1. In FIG. 5, an operating sequence focusing on one particular replacement part 20 is shown, but in the case of fitting multiple replacement parts 20 the same processing is executed for each replacement part 20.

If a power supply of the image forming apparatus 1 is turned on (S11), the identification information acquisition section 16*a* reads out an individual identification number of the replacement part 20 from the memory 21 (S12). If this read operation is not carried out normally (S13: NO) the control section 16*h* executes predetermined error processing (S14). Here, as the particular error processing, for example, it is possible to display an error screen on the display of the UI 12 and to prevent the image formation operation. The replacement part 20 being an unapproved part, the replacement part 20 not being fitted, and the memory 21 or the reader/writer 11 being damaged can be considered as reasons for the individual identification number not being read normally.

In the event that the individual identification number has been read normally (S13: YES), the determination section 16*c* references the storage device 14, and determines whether or not the read individual identification number matches either of the individual identification numbers held in the first or second table. Specifically, it is determined whether or not the read out individual identification number has been registered in the storage device 14.

If it is determined that there is a match (S15: YES), the determination section 16*c* determines that the replacement part 20 is not an approved part and the determination result is notified to the processing section 16*g* (S16). In response to this notification, the processing section 16*g* executes predetermined processing corresponding to a case where a part other than an approved part has been fitted (S17).

On the other hand, if it is determined that there is no match (S15: NO), the information acquisition section 16*b* reads out information indicating whether or not the replacement part 20 is an approved part from the memory 21 (S18). The determination section 16*c* then determines whether or not the replacement part 20 is an approved part based on the read information in accordance with a predetermined determination method (S19). Two specific examples of the predetermined determination method described above will be given.

With a first specified example, the determination section 16*c* carries out determination using counter values representing a cumulative print number or a cumulative rotation number of the replacement part 20. Specifically, the determination section 16*c* stores the counter values in the memory 21 and stores a data set of the individual identification number and the counter value in the storage device 14. Here, these counter values are updated as required by the determination section 16*c*. Also, when the replacement part is replaced, a new data set is added to the storage device 14.

In step S18, the information acquisition section 16*b* reads out an individual identification number and counter value as information indicating whether or not the replacement part 20 is an approved part from the memory 21. In step S19, the determination section 16*c* references the storage device 14 and determines whether or not there is a data set having an individual identification number corresponding to the read out individual identification number and a counter value that is larger than the read out counter value. In the event that it is determined that a data set does not exist (that is, when a reverse phenomenon of the counter value is not detected), it is determined that the replacement part is an approved part, and in the event that it is determined that a data set does exist (that is, when a reverse phenomenon of the counter value is detected) it is determined that the replacement part 20 is not an approved part.

With a second specific example, determination is carried out using encryption/decryption. Specifically, predetermined information is encrypted in advance using a predetermined encryption method, and the encrypted information is stored in the memory 21. Here, predetermined information that is subjected to encryption can be any type of information, but is, for example, control information such as a manufacturing variation compensation value and a usage history. Also, an encryption algorithm and encryption key for a predetermined encryption method are not particularly limited. Here, however, in order to organically correlate the information representing whether or not a part is an approved part with the individual identification information, and to prevent dead copy of information held in the memory 21, the individual identification number is used as a parameter for encryption. Specifically, an encryption key is generated based on the individual identification number, and encryption is carried out using the generated encryption key. The parameter in the encryption is not limited to an encryption key, and can also be an initial vector or the like used with CBC (Cipher Block Chaining) mode, etc.

In step S18, the information acquisition section 16*b* reads out from the memory 21 an individual identification number and encrypted information as information indicating whether or not the replacement part 20 is an approved part. In step S19 the determination section 16*c* generates a decryption key based on the read out individual identification number, and decryption of encrypted information is carried out using the generated decryption key. If decryption is achieved, it is determined that the replacement part 20 is an approved part, while if decryption is not achieved it is determined that the replacement part 20 is not an approved part.

In the above-described first and second specific examples, it is also possible to omit reading of the individual identification number by the information acquisition section 16*b*, and to use the individual identification number read out by the identification information acquisition section 16*a* in the determination.

If the result of determination processing in step S19 is that the replacement part is not an approved part (S19: NO), the determination section 16*c* notifies the determination result to the first registration section 16*d* and the processing section 16*g*. In response to this notification, the first registration section 16*d* registers the individual identification number read out by the identification information acquisition section 16*a* in the first table of the storage device 14, correlating the type of replacement part and time of fitting (S20). The processing section 16*g* performs predetermined processing on the memory 21 in response to the above-described notification (S21). In one aspect, the processing section 16*g* deletes (including initializing) or destroys some or all of the information being stored in the memory 21. In this way, it is possible to reliably prevent a replacement part that has been determined to be not an approved part once being erroneously determined to be an approved part the next time. With another aspect, the processing section 16*g* causes a transition of the memory 21 to a state where it can not be written to. For example, a write inhibit attribute is set in attribute information possessed by the RFID tag by setting a bit indicating that write is impossible permanently via the reader/writer 11, or structural elements for writing data inside the RFID tag are electrically or mechanically destroyed. In this way it is possible to prevent overwriting or deletion of information in the memory 21. As a result, it becomes possible for a manufacturer or vendor to evaluate the content of the memory 21 at the point in time that it was determined to be not an approved part, to investigate the reason the part was determined to be not an approved part. For example, it is possible to determine whether or not the replacement part 20 is an unapproved part such as counterfeit, and whether or not data of the memory 21 is destroyed. Next, the processing section 16*g* executes predetermined processing corresponding to a case where a part other than an approved part has been fitted (S22).

On the other hand, if the result of determination processing in step S19 is that the replacement part is an approved part (S19: YES), the determination section 16*c* notifies the determination result to the control section 16*h*. In response to this notification, the control section 16*h* controls the image forming apparatus 1 so as to operate in an operating mode corresponding to the case where an approved part has been fitted as the replacement part 20 (hereafter referred to as approved part mode) (S23). In this way, the image forming apparatus 1 performs an image formation operation suited to the approved part. In approved part mode, all functions possessed by the image forming apparatus 1 can be realized.

With the above description, determination of a replacement part is performed when a power supply is turned on, but it is also possible to carry out determination at an appropriate time, such as when fitting of a replacement part is detected, when opening or closing of a main body cover is detected, etc.

[Processing Corresponding to a Case Where Other Than an Approved Part is Fitted.]

In the following a detailed description will be given of processing corresponding to a case where a part other than an approved part has been fitted. This processing is executed in steps S17 and S22 of FIG. 5. Here, separate descriptions will be given for when the image formation function is stopped and when the image formation function is continued. The processing shown in the following can be executed by the control section 16*h* in accordance with instructions from the processing section 16*g*, or carried out by the processing section 16*g*.

(When the Image Formation Function is Stopped)

As already described, when replacement parts whose use is not confirmed, such as imitation parts, counterfeit parts, pirated versions, etc., are fitted to the apparatus main body 10, various problems or disadvantages may arise, because operation in this case is outside the range assumed by the manufacturer during the design phase. For example, there is a fear of the occurrence of problems regarding image quality, erroneous operation, and damage to the apparatus main body.

Here, the processing section 16*g* causes the image formation function of the image forming apparatus 1 to be suspended in order to reliably avoid these disadvantages. At this time, it is preferable to display the fact that a replacement part that is not approved has been fitted on a display of the UI 12, so that the user may understand the reason for the suspension of the function.

Here, if the image formation function for maintenance or management of the image forming apparatus 1 is suspended, maintenance operations carried out by a service engineer will be impeded. The processing section 16*g* therefore causes the image formation function to be suspended, except for the image formation function for maintenance or management. As an image formation function for maintenance or management, for example, there is a function for printing out a status report or a setting list showing the current state of a machine.

Also, in the event that the replacement part determined to be not an approved part is a toner cartridge, at the determination time point, toner of an approved part remains in a supply passage and reserve tank, etc. Here, the supply passage is a passage for supplying toner from a toner cartridge to a developer. A reserve tank is provided in the supply passage, and is a retention vessel for temporarily retaining a specified amount of toner. From determination that a toner cartridge is not approved until running out of toner remaining in the reserve tanks, etc., ordinary image formation function is possible, and it is not necessary to cause suspension of the image formation function. The processing section 16*g* causes suspension of the image formation function after the predetermined amount of toner has been consumed, in the event that it is determined that the toner cartridge is not an approved part. Here, the predetermined amount is, for example, an amount of toner remaining in the supply passage at the point in time the determination is made, an amount of toner remaining in the reserve tanks, or the sum amount of these two. For example, a number of images to be formed corresponding to an amount of toner remaining in the reserve tank, etc. is determined in advance, and the processing section 16*g* causes suspension of the image formation function at the time that predetermined number of images have been formed. Otherwise, the processing section 16*g* calculates a consumed amount of toner from image data for every image formation, and causes suspension of the image formation function at the point in time that a cumulative value for toner consumed amount reaches the remaining toner amount, or, in a suspended state wherein discharge of toner from the toner cartridge to the supply passage is suspended, the processing section 16*g* continues the image formation function, and at the point in time where a toner remaining amount detection sensor of the developer detects that there is no toner, the image formation function is suspended. However, it is also possible for the determination as to whether or not the predetermined amount of toner has been consumed to be carried out using a suitable method. In such a case, it is preferable to present a remaining number of images that can be formed or an estimated value, to the user. For example, this may be displayed on a control panel or the like.

Also, in the event that the image forming apparatus 1 is provided with a facsimile function, an Internet facsimile function, or a mail print function, it is preferable to print image data received using these functions if at all possible. When received image data is stored in the storage device 14 as an image data accumulating section, as the storage period becomes longer the possibility of the image data being lost increases. For example, there may be cases where image data is lost due to power failure, failure of a hard disk unit, thunderbolt, abnormal operation of the image forming apparatus 1, etc. In particular, in the event of loss of image data received normally by a facsimile function, this may cause major problems between the sender and the receiver.

Therefore, according to one aspect, the processing section 16*g* suspends the image formation function except for the image formation function for the facsimile function, the Internet facsimile function, or the mail print function.

In another aspect of the invention, the processing section 16*g* holds image data received by the facsimile function, Internet facsimile function, or mail print function in the storage device 14 as an image data accumulation section, and in the case of a state where a storage region of the storage device 14 used to hold image data is full, a predetermined number of image data being held in the storage region are printed. Here, determination as to whether or not the full state exists can be carried out using an appropriate method, but it is possible to determine that the full state exists when an overall data amount of held image data is greater than a predetermined value or when a storage region for storing newly received image data can not be secured. The number of prints performed when the full state is encountered can also be set appropriately, but the print number can be, for example, a fixed number, a number corresponding to a fixed data amount, or a number of prints that enables newly received image data to be stored.

Also, the processing section 16g may prohibit receipt of image data by the facsimile function, the Internet facsimile function, or the mail print function.

(When the Image Formation Function is Continued)

As has already been described, for the apparatus main body 10, when an unapproved part such as an imitation part is fitted as a replacement part, there is a possibility of problems such as damage arising. Despite this, there may still be people who wish to use such an unapproved part.

For this reason, in order to satisfy such a desire to use unapproved parts while avoiding disadvantages accompanying use of such unapproved parts, as operating modes of the image forming apparatus 1 an unapproved part mode for the case where an unapproved part is fitted is provided as well as the approved part mode for the case where an approved part is fitted. The processing section 16g controls the image forming apparatus 1 so as to operate in unapproved part mode when it has been determined that the replacement part 20 is not an approved part. Specifically, in order to satisfy the desire to use unapproved parts, the processing section 16g continues the image formation function of the image forming apparatus 1 while limiting the functions of the image forming apparatus 1 executed in approved part mode in order to avoid disadvantages accompanying use of unapproved parts.

A specific example of unapproved part mode will be described by comparison to approved part mode. Here description will be divided into specific examples 1 to 4, but it is also possible to appropriately combine these examples.

FIRST SPECIFIC EXAMPLES

In approved part mode, in order to compensate for manufacturing variations and maintain image quality, etc., attribute information of the replacement part is acquired from the replacement part 20 and operation is carried out based on this attribute information. For example, the image forming apparatus 1 reads out control information (a compensation value, counter value, etc.) from the memory 21, and determines voltage, current, temperature etc, for image formation based on this control information. As attribute information of the replacement part 20, for example, barcode information on the replacement part 20 and physical characteristic values for the replacement part 20 can be considered, as well as control information stored in the memory 21.

When a particular replacement part 20 is an unapproved part, there is a possibility that inappropriate information will be written in the memory 2l of there placement part 20. There is also the possibility that the physical characteristic of the replacement part 20 will be different from that of an approved part. For this reason, there is a possibility that attribute information obtained from an unapproved replacement part 20 will be completely different from that of an approved part, and if such information is used in control of the image forming apparatus 1, there is a possibility that disadvantages such as an apparatus failure arise.

In unapproved part mode, instead of attribute information obtained from the replacement part 20, operation is carried out based on information stored in advance in the apparatus main body 10.

SECOND SPECIFIC EXAMPLE

In the approved part mode, attribute information of the replacement part is acquired from the replacement part 20 and predetermined functions are realized using this attribute information. For example, toner remaining amount information can be read out from the memory 21 of a toner cartridge and amount of toner remaining displayed on a control panel using this toner remaining amount information.

When a toner cartridge is an unapproved part, there is a possibility of incorrect information being written in the memory 21. For this reason, toner remaining amount information is read out from the unapproved toner cartridge, and if display of toner remaining amount is carried out based on this toner remaining amount information, incorrect information will be conveyed to the user.

In an unapproved part mode, therefore, in the image forming apparatus 1 predetermined functions realized using attribute information acquired from the replacement part 20, such as a function of displaying the toner remaining amount, are suspended. The above-described predetermined function is not limited to the display of toner remaining amount.

THIRD SPECIFIC EXAMPLE

The approved part mode is set so as to acquire predetermined quality when an approved part is fitted as the replacement part 20. Specifically, parameters in the approved part mode such as voltage, current, and temperature are set based on the assumption that the replacement part 20 satisfies predetermined characteristics such as, for example, withstand voltage, flame resistance, abrasion resistance, etc.

With an unapproved part, it is not clear whether these predetermined characteristics are satisfied or not. Therefore, when an unapproved part is fitted, if the parameters for an approved part are used without modification, problems may arise such as unforeseen discharge, rise in temperature, or wearing of parts.

For this reason, in the unapproved part mode the image forming apparatus 1 operates within an operation limited range that is more severe than for approved part mode. For example, in the unapproved part mode, the upper and lower limits of output values of voltage, current, and temperature, etc., are set more strictly than for the approved part mode.

FOURTH SPECIFIC EXAMPLE

As has been described with the first to third specific examples above, operation of the image forming apparatus 1 is different for approved part mode and unapproved part mode. As such, there may be cases where a user mistakes operation in the unapproved part mode for a failure of the image forming apparatus 1. Also, it is preferable to notify the fact that an unapproved part has been fitted to ensure that the user is aware of this situation.

In unapproved part mode, the fact that the image forming apparatus 1 is currently operating in unapproved part mode is notified to the user. For example, an indication of unapproved part mode is displayed on a control panel or a display screen of a PC.

With the above-described embodiment, the following effects are achieved.

(1) An image forming apparatus (or part determination device) determines whether or not a replacement part fitted in the image forming apparatus is an approved part, and, in the event that it is determined that the replacement part is not an approved part, an individual identification number for that replacement part is registered in a predetermined first storage region. In this way it is possible to register a history of fitting unapproved parts. As a result, investigation of the cause of problems occurring in an image forming apparatus is aided through use of the registered fitting history. It is also possible to understand distribution conditions for unapproved parts in the market place. It is also possible to simplify and speed up determination as to whether or not the replacement parts are approved parts.

(2) With an image forming apparatus (or part determination device), in the event that a fitting history for unapproved parts is registered inside the apparatus, the fitting history is output to an external information processing device or a display screen. In this way, it is made possible to make effective use of a history stored within the apparatus. It is also possible to collect together histories stored inside plural apparatuses, and to manage these histories.

(3) With an image forming apparatus (or part determination device), in the event that individual identification information acquired from a replacement part matches some individual identification information stored in a predetermined first storage region, it is determined that the replacement part is not an approved part regardless of information indicating whether or not the replacement part is an approved part obtained from the replacement part. In this way, for replacement parts that have been determined to be not approved parts, it is possible to omit processing for acquiring information indicating whether or not a replacement part is an approved part from the replacement part and processing for carrying out determination based on information indicating whether or not the part is an approved part, and to simplify and speed up processing.

(4) With an image forming apparatus (or part determination device), individual identification information for a replacement part that has been determined to be not an approved part by another apparatus is acquired externally, and registered in a predetermined second storage region. In the event that individual identification information acquired from a replacement part matches some individual identification information stored in either of the first and second storage regions, it is determined that the replacement part is not an approved part regardless of information indicating whether or not the replacement part is an approved part obtained from the replacement part. In this manner, it is possible to omit processing for acquiring information indicating whether or not a replacement part is an approved part from the replacement part and processing for carrying out determination based on information indicating whether or not the part is an approved part, and to simplify and speed up processing not only for replacement parts that have been determined to be not approved parts by the apparatus itself, but also for replacement parts that have been determined to be not approved parts by another apparatus.

(5) In the event that an image forming apparatus (or part determination device) determines that a replacement part is not an approved part, information stored in a non-volatile memory of the replacement part is deleted or destroyed. In this way, it is possible to reliably prevent a replacement part that has been determined to be not an approved part once being erroneously determined to be an approved part the next time.

(6) In the event that an image forming apparatus (or part determination device) determines that a replacement part is not an approved part, a transition is made to a state where a non-volatile memory of the replacement part can not be written to. In this way it is possible to prevent overwriting or deletion of information in the memory. As a result, it becomes possible for a manufacturer or vendor to evaluate the content of the memory at the point in time that it was determined to be not an approved part, to investigate the reason the part was determined to be not an approved part.

(7) In the event that an image forming apparatus (or part determination device) determines that a replacement part is not an approved part, an image formation function of the image forming apparatus is suspended. In this way it is possible to avoid disadvantages such as unforeseen operation, erroneous operation, apparatus failure, and damage accompanying use of replacement parts other than approved parts.

(8) In the event that an image forming apparatus (or part determination device) determines that a replacement part is not an approved part, an image formation function of the image forming apparatus is suspended, except for image formation functions for maintenance or management of the image forming apparatus. As a result, because image formation functions for maintenance or management are continued, it is also possible to avoid disadvantages accompanying use of a replacement part other than an approved part while carrying out appropriate maintenance and management of the image forming apparatus even in the event that a replacement part other than an approved part is fitted.

(9) With the image forming apparatus (or part determination device), the image formation function is suspended after a predetermined amount of toner has been consumed, in the event that it is determined that a toner cartridge is not an approved part. In this way, it is possible to carry out image formation using toner of an approved part remaining in a reserve tank etc. after an unapproved toner cartridge has been fitted.

(10) In the event that an image forming apparatus (or part determination device) determines that a replacement part is not an approved part, the image formation functions, except for an image formation function for a facsimile function, an Internet facsimile function, or a mail print function, are suspended. In this way it is possible to reduce the possibility of image data received by these functions being lost. As a result, it is possible to suppress the occurrence of problems and damage accompanying loss of image data. In particular, since there is a possibility of major problems between the sender and the receiver in the event of loss of image data received normally by a facsimile function, the effects of not suspending an image formation function for a facsimile function are significant.

(11) In the event that an image forming apparatus (or part determination device) determines that a replacement part is not an approved part, image data received by the facsimile function, Internet facsimile function, or mail print function is held in a storage region for holding image data, and in the case of a state where the storage region is full, a predetermined number of image data being held are printed. In this way it is possible to avoid loss of image data caused by the image data holding storage region being full. In particular, the effect of printing image data received by a facsimile function is significant.

(12) In the event that an image forming apparatus (or part determination device) determines that a replacement part is not an approved part, receipt of image data by a facsimile function, an Internet facsimile function, or a mail print function is prohibited. In this way it is possible to reliably prevent the loss of image data received by these functions. As a result, it is possible to reliably avoid the occurrence of problems and damage accompanying loss of image data. In particular, the effect of prohibiting the receipt of image data by a facsimile function is significant.

(13) In the event that an image forming apparatus (or part determination device) determines that a replacement part is not an approved part, an image formation function of the image forming apparatus is continued while limiting functions of the image forming apparatus. In this way it is possible to satisfy a desire to use replacement parts other than approved parts while avoiding disadvantages accompanying the use of such replacement parts.

The present invention is not limited to the above-described embodiment, and various modifications are possible without deviating from the spirit of this invention.

For example, in the examples used to illustrate the above-described embodiment, the part determination device is physically integrated with an image forming apparatus 1, but it is not necessary that these two devices be integrated, and it is also possible for some or all of the functions of the part determination device to be realized by a device separate from the image forming apparatus 1. Examples of such a separate device include devices such as a PC connected to the image forming apparatus via a network such as a LAN or the Internet, or a device connected to the image forming apparatus 1 by short range communication in a wired or wireless manner.

Also, in the above-described embodiment, the information indicating whether or not a replacement part is approved and the individual identification information are held in the memory 21, but this information maybe held in another form, such as stored in a hologram or a two-dimensional bar code. It is also possible for physical features or values of a replacement part 20 to be used as the information indicating whether or not the part is approved. There are also further cases where information indicating whether or not the part is approved and individual identification information are physically held in separate media.

Also, with the above-described embodiment, the replacement part 20 has been typified by a drum cartridge, a development unit, a toner cartridge, a transfer unit, or a fixing unit, etc. but this is not limiting, and can also be typified by a paper feed roll, a paper tray, an image input device (IIT), an image data generating device, or an optional device. As the optional device it is possible to consider a double sided feed unit, a trayless double sided feed unit, a finisher (a device for handling stapling, binding, punching, folding, etc.), a large capacity paper feed tray, a large capacity catch tray, a manual feed tray, or a special paper feed unit, etc.

Also, the above embodiment was described using an image forming apparatus as an example, but the part determination device of this embodiment can be widely applied to apparatuses having replaceable parts. Here, a television, data recording and playback device (video, hard disk recorder, etc.), speakers, telephone, mobile telephone, personal computer, and automobile can be considered as the apparatus having replaceable parts. In a data recording and playback device, magnetic tape, magnetic disks, optical disks, magneto-optical discs, memory cards, and paper tape are typical examples of a replacement part. Tires, battery, muffler, air cleaner, oil cleaner, and lights are typical examples of replacement parts for an automobile. Structure and operation of an apparatus having replacement parts with the part determination device are substantially the same as for the image forming apparatus 1 of the above-described embodiment. with the apparatus having replacement parts, in unapproved part mode, functions of the apparatus realized in approved part mode are limited while continuing minimum functions as the apparatus. Here, as the minimum functions as the apparatus, there are basic functions derived from the use of the apparatus, for example, a function for receiving and displaying images in the case of a television, a function of carrying out recording and playback of information in the case of a hard disc recorder, and a call function in the case of a telephone.

The entire disclosure of Japanese Patent Application No. 2004-135295 filed on Apr. 30, 2004 including the specification, claims, drawings, and abstract is incorporated herein by reference.

What is claimed is:

1. A part determination device used in an apparatus having a replacement part, comprising:

an identification information acquisition section that acquires individual identification information for identifying a replacement part from the replacement part;

an information acquisition section that acquires information indicating whether or not the replacement part is an approved part from the replacement part;

a determination section that determines whether or not the replacement part is an approved part based on information acquired by the information acquisition section; and a first registration section that registers individual identification information acquired by the identification information acquisition section in a predetermined first storage region when it is determined by the determination section that the replacement part is not an approved part.

2. The part determination device according to claim 1, wherein a non-volatile memory is provided in the replacement parts;

the identification information acquisition section acquires individual identification information unique to the memory from the memory as individual identification information of the replacement part; and the information acquisition section acquires information indicating whether or not the replacement part is an approved part from the memory.

3. The part determination device according to claim 1, wherein the first storage region is provided inside the part determination device, and further comprising an output section that outputs individual identification information stored in the first storage region to an external information processing device or a display screen.

4. The part determination device according to claim 1, wherein the determination section determines whether or not individual identification information acquired by the identification information acquisition section matches any individual identification information stored in the first storage region, and when it is determined that there is a match, it is determined that the replacement part is not an approved part regardless of the information indicating whether or not the part is an approved part acquired from the replacement part.

5. The part determination device according to claim 1, further comprising a second registration section that acquires individual identification information of a replacement part that has been determined to be not an approved part from outside, and registers this information in a predetermined second storage region, and wherein the determination section determines whether or not individual identification information acquired by the identification information acquisition section matches any individual identification information stored in the first storage region or the second storage region, and, when it is determined that there is a match, it is determined that the replacement part is not an approved part regardless of the information indicating whether or not the part is an approved part acquired from the replacement part.

6. The part determination device according to claim 1, further comprising a processing section that executes predetermined processing corresponding to a case where other than an approved part has been fitted when it is determined by the determination section that the replacement part is not an approved part.

7. The part determination device according to claim 6, wherein a non-volatile memory that stores information indicating whether or not the replacement part is an approved part is provided in the replacement part; and when it is determined by the determination section that a replacement part is not an approved part, the processing section deletes or destroys information indicating whether or not the replacement part is an approved part stored in the non-volatile memory.

8. The part determination device according to claim 6, wherein a non-volatile memory that stores information indicating whether or not the replacement part is an approved part is provided in the replacement part; and when it is determined by the determination section that a replacement part is not an approved part, the processing section causes a transition to a state where the memory can not be written to.

9. The part determination device according to claim 6, wherein when it is determined by the determination section that a replacement part is not an approved part, the processing section causes the apparatus to be stopped.

10. The part determination device according to claim 6, wherein when it is determined by the determination section that a replacement part is not an approved part, the processing section continues with minimum functions as the apparatus, while limiting functions of the apparatus.

11. The part determination device according to claim 6, wherein the apparatus is an image forming apparatus, and when it is determined by the determination section that a replacement part is not an approved part, the processing section causes image formation functions of the image forming apparatus to be stopped.

12. The part determination device according to claim 11, wherein the processing section causes the image formation functions of the image forming apparatus to be stopped, except for the image formation functions for maintenance or management of the image forming apparatus.

13. The part determination device according to claim 11, wherein the image forming apparatus is an electrophotographic apparatus fitted with a toner cartridge filled with refilling toner as a replacement part; and when it is determined by the determination section that the toner cartridge is not an approved part , the processing section causes the image formation functions to be suspended after a predetermined amount of toner has been consumed.

14. The part determination device according to claim 11, wherein the processing section stops the image formation functions except for image formation functions for a facsimile function, an Internet facsimile function, or a mail print function.

15. The part determination device according to claim 11, wherein the image forming apparatus has a facsimile function, an Internet facsimile function, or a mail print function, and is further provided with an image data accumulation section that accumulates image data received using these functions; and wherein when it is determined that the image data accumulation section is in a full state, the processing section causes printing of a predetermined number of items of image data accumulated in the image data accumulation section.

16. The part determination device according to claim 11, wherein the processing section stops image formation functions and prohibits receipt of image data by a facsimile function, an Internet facsimile function, or a mail print function.

17. The part determination device according to claim 6, wherein the apparatus is an image forming apparatus, and when it is determined by the determination section that a replacement part is not an approved part, the processing section continues with image formation functions of the image forming apparatus, while limiting functions of the image forming apparatus.

18. An apparatus having a replacement part that can be attached and removed, having the part determination device according to claim 1.

19. An image forming apparatus having a replacement part that can be attached and removed, having the part determination device according to claim 1.

20. A part determination method used in an apparatus having a replacement part that can be attached and removed, comprising:

an identification information acquisition step for acquiring individual identification information for identifying a replacement part from the replacement part;

an information acquisition step for acquiring information indicating whether or not the replacement part is an approved part from the replacement part;

a determination step for determining whether or not the replacement part is an approved part based on information acquired in the information acquisition step; and a registration step for registering individual identification information acquired in the identification information acquisition step in a predetermined storage region when it is determined in the determination step that the replacement part is not an approved part.

* * * * *